US005375722A

United States Patent [19]

Leary et al.

[11] Patent Number: 5,375,722

[45] Date of Patent: Dec. 27, 1994

[54] CARTON MONITORING SYSTEM

[75] Inventors: Kevin C. Leary; Kenneth Santefort, both of Mokena, Ill.

[73] Assignee: W. H. Leary Co., Inc., Mokena, Ill.

[21] Appl. No.: 849,512

[22] Filed: Mar. 11, 1992

[51] Int. Cl.[5] ..... B07C 5/00

[52] U.S. Cl. ..... 209/578; 209/3.3; 209/566; 209/598; 209/705; 340/674; 250/562; 250/572; 493/128; 356/237

[58] Field of Search ..... 209/546, 702, 705, 578, 209/577, 566, 565, 560, 598, 587, 588, 3.3; 356/237; 340/674; 250/562, 572; 493/131, 128, 55

[56] References Cited

U.S. PATENT DOCUMENTS

| | | | |
|---|---|---|---|
| 3,040,323 | 6/1962 | Brenner et al. | 209/3.3 |
| 3,340,847 | 9/1967 | Miller et al. | 118/2 |
| 3,559,806 | 2/1971 | Bevins | 209/74 |
| 3,661,258 | 5/1972 | Madalo et al. | 209/111.7 |
| 3,812,373 | 5/1974 | Hosoe et al. | 250/562 |
| 3,975,261 | 8/1976 | Beck | 209/565 |
| 4,172,347 | 10/1979 | Nitz | 53/52 |
| 4,448,820 | 5/1984 | Buschor | 427/424 |
| 4,498,415 | 2/1985 | Tsuchiya et al. | 118/712 |
| 4,704,603 | 11/1987 | Edwards et al. | 340/674 |
| 4,733,226 | 3/1988 | Kasuya et al. | 340/674 |
| 4,776,466 | 10/1988 | Yoshida | 209/565 |
| 4,778,999 | 10/1988 | Fisher | 250/461.1 |
| 5,024,709 | 6/1991 | Faulkner et al. | 493/128 |
| 5,187,376 | 2/1993 | Hashimoto et al. | 250/562 |

*Primary Examiner*—H. Grant Skaggs
*Attorney, Agent, or Firm*—Wood, Phillips, VanSanten, Hoffman & Ertel

[57] ABSTRACT

A carton glue monitoring system includes a conveyor moving a plurality of cartons in a first direction. An encoder provides pulses at a rate proportional to conveyor line speed. A glue applicator applies a glue strip having a fluorescent material added thereto to the cartons on the conveyor. A glue check station includes a UV source for illuminating the fluorescent material in the glue and a UV sensor for sensing the fluorescent material. The glue station further includes a glue skip detector and an excess glue detector for generating a glue flag and for holding the glue flag until the carton exits the glue station. A glue shift register includes Y registers and is connected to the UV sensor and the encoder for shifting the glue flag in the Y registers. Y is proportional to the encoder rate and a distance between the rejection marking device and the glue station exit minus the carton length. The glue shift register outputs the glue flag to the rejection device after the glue flag is shifted in the Y registers. A rejection device includes a carton sensor and a rejection shift register having Z registers. The rejection device is connected to the encoder and the glue shift register. The rejection shift register shifts the glue flag Z times wherein Z is proportional to the carton length. The rejection device stamps or kicks the carton when the glue flag is shifted through the Z registers.

29 Claims, 13 Drawing Sheets

CARTON MONITORING SYSTEM

FIELD OF THE INVENTION

This invention relates to a glue monitoring system for a carton conveyor and, more particularly, to a means for detecting glue skips or excess glue and for kicking or stamping a rejected carton.

BACKGROUND OF THE INVENTION

In a carton monitoring system, a carton moves on a conveyor past a glue station where glue is applied to a portion thereof. After the glue is applied to the carton, the carton is folded and pressure is applied to the carton while the glue dries. Some time later, the cartons are filled with a product. If the cartons are improperly glued, the cartons may come apart, for example during shipping, and the product may be damaged or lost. Therefore, it is desirable to detect improper application of glue, e.g., glue skips and excess glue, and to mark or reject the improperly glued carton using a rejection device immediately after glue is applied to avoid individual inspection of the cartons.

Systems using a UV source and a UV sensor to detect a fluorescent material added to the glue have been proposed (see Edwards, et al. U.S. Pat. No. 4,704,603). However, prior art systems have several problems: the prior art systems are unable to synchronize the timing of the operation of the rejection device with the carton moving at line speed; the prior art systems cannot accommodate cartons of variable length; and the prior art systems do not operate when a distance between cartons varies.

Prior art systems also lack a dependable means for detecting and rejecting a double-stacked carton, a carton with a bent or removed flap, or a carton with an insert missing when the carton is moving at line speeds.

SUMMARY OF THE INVENTION

A carton glue monitoring system includes a conveyor moving a plurality of cartons in a first direction. An encoder provides pulses at a rate proportional to conveyor line speed. A glue applicator applies a glue strip to the cartons on the conveyor in the first direction. The glue has a fluorescent material added thereto. A glue check station includes a UV source for illuminating the fluorescent material in the glue and a UV sensor for sensing the fluorescent material. The glue station further includes a glue skip detector and an excess glue detector for generating a glue flag and for holding the glue flag until the carton exits the glue station. A glue shift register includes Y registers and is connected to the UV sensor and the encoder. The glue shift register shifts the glue flag in the Y registers. Y is proportional to the encoder rate and a distance between the rejection marking device and the glue station exit minus the carton length. The glue shift register outputs the glue flag to a rejection device after the glue flag is shifted in the Y registers. The rejection device includes a carton sensor and a rejection shift register having Z registers. The rejection device is connected to the encoder and the glue shift register. The rejection shift register shifts the glue flag Z times wherein Z is proportional to the carton length. The rejection device stamps or kicks the carton when the glue flag is shifted through the Z registers.

A skew station determines if the carton is skewed, provides a skew flag if the carton is skewed, and holds the skew flag until the carton exits the skew station. A storing device stores the skew flag until the front edge of the carton reaches the rejection device and then transmits the skew flag to the rejection shift register.

A flap check station includes a flap timing sensor for sensing a trigger flap and for providing a flap timing pulse when said trigger flap is detected. A flap sensing means detects the first and second flaps and provides a flap flag if the first and second flaps are not detected during the flap timing pulse. A storing device stores the flap flag until the front edge of the carton reaches the rejection device and then transmits the flap flag to the rejection shift register.

Other objects and advantages will be readily apparent.

DETAILED DESCRIPTION

Figure 1:
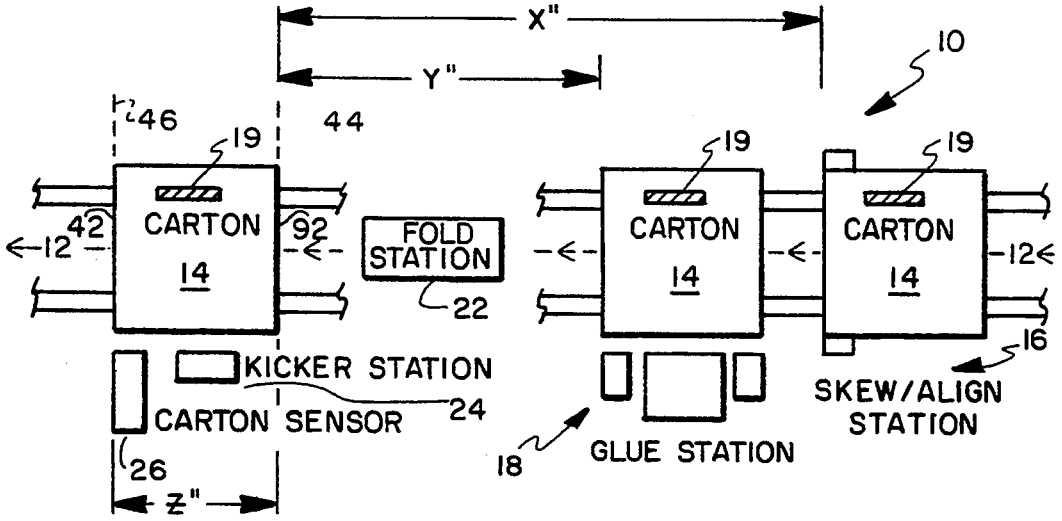
FIG. 1 is a functional block diagram of the conveyor and carton glue monitoring system.

FIG. 1 shows a monitoring system 10 for a conveyor 12 which moves a plurality of cartons 14 one at a time past a skew station 16. The skew station 16 checks the alignment of carton 14 as it passes on the conveyor 12. After passing the skew station 16, the carton 14 enters a glue station 18 which checks the carton 14 for glue skips or excess glue. A glue strip 19 having a fluorescent material added thereto can be applied by known methods such as a roller or spray in the glue station 18 or before entering the glue station 18. After exiting the glue station 18, the carton 14 enters a fold station 22 where the carton 14 is folded, and then a kicker station 24 including a carton sensor 26. If the carton 14 is skewed (as determined in the skew station 16) or if glue is not properly applied (as determined in the glue station 18), the kicker station 24 will identify the carton 14 by either kicking or marking the carton 14.

Figure 2:
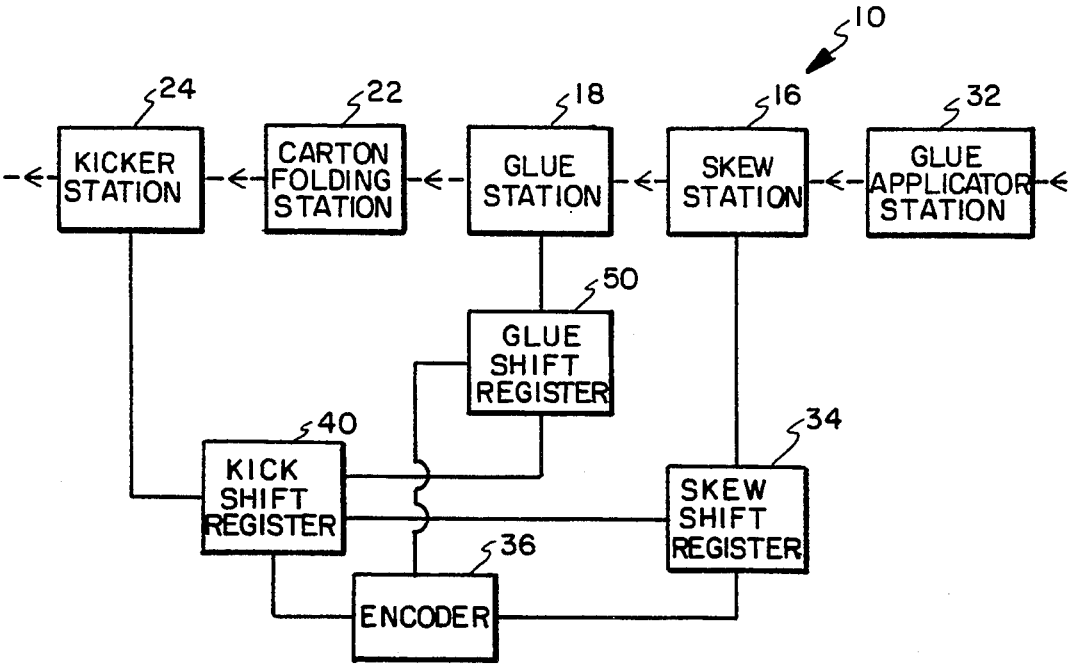
FIG. 2 is a functional block diagram of the carton glue monitoring system.

FIG. 2 shows a functional block diagram of the monitoring system 10. If the carton 14 is not properly aligned, the skew station 16 generates a skew flag which is output to a skew shift register 34 at the moment the carton 14 exits the skew station 16. An encoder 36 connected to the conveyor 12 provides pulses at a rate proportional to the speed of the conveyor 12. For example, the encoder 36 can provide one pulse per inch of conveyor movement.

The skew shift register 34 shifts the skew flag in its registers and outputs the skew flag to a kick shift register 40 when a front edge of the skewed carton 14 reaches the kicker station 24. The exit of the skew station 16 is located a distance X inches from the entrance to the kicker station 24. The carton 14 has a length of Z inches. Assuming that the conveyor moves at one inch per second, and the encoder 36 provides one pulse per inch of conveyor movement, the skew shift register 34 would have X-Z registers. If the skew station 16 generates the skew flag, the skew shift register 34 shifts the skew flag X-Z times at the encoder rate of 1 pulse per inch (e.g., the skew flag moves synchronously with the skewed carton 14). The skew shift register 34 outputs the skew flag to the kick shift register 40 just as a front edge 42 of the skewed carton 14 passes dotted line 44 in FIG. 1. The kick shift register 40 shifts the skew flag Z times to center the skewed carton 14 between a dotted line 46 and the dotted line 44. The carton 14 can then be kicked or marked by the kicker station 24.

Glue station 18 and glue shift register 50 operate similarly to the skew station 16 and skew shift register 34 except that glue shift register 50 internally shifts a glue flag Y-Z times due to a shorter distance between an exit of glue station 18 and the kicker station 24. The glue station 18 detects glue skips or excess application of glue, as will be described in greater detail below.

Figure 3A:
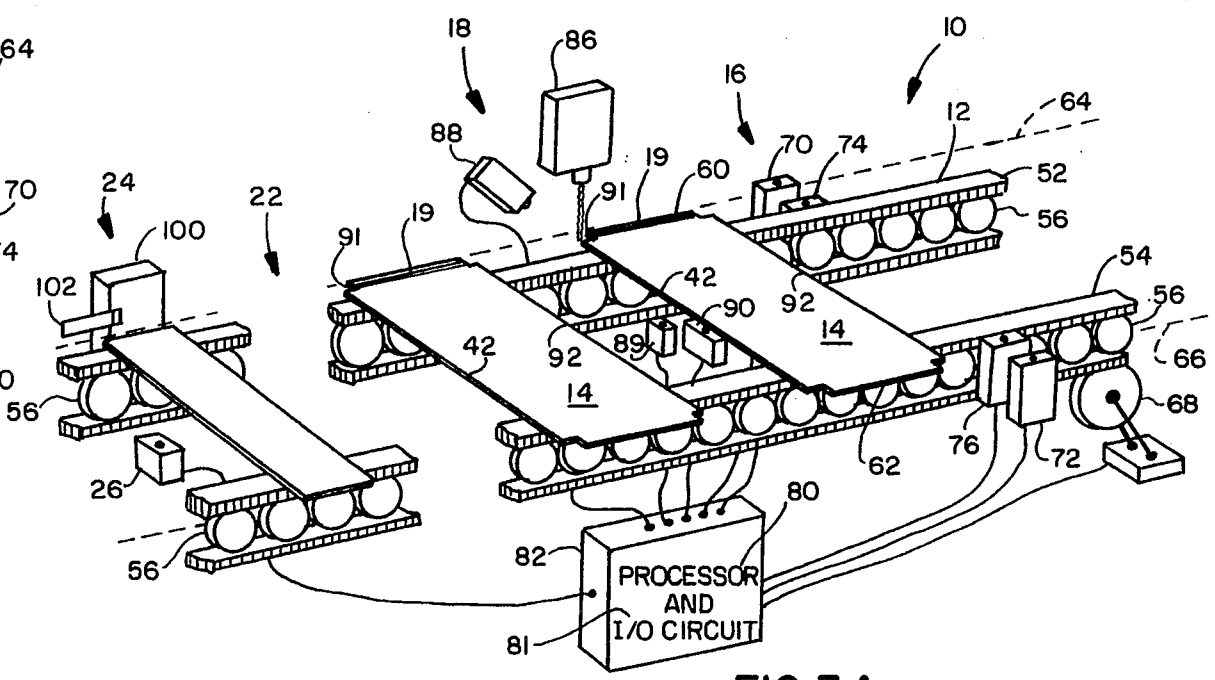
FIG. 3A is a perspective view of the carton glue monitoring system on a conveyor.

FIG. 3A shows a perspective view of the monitoring system 10. The conveyor 12 includes first and second endless belts 52, 54 guided on a plurality of wheels 56. The first and second belts 52, 54 are driven synchronously by a drive motor (not shown) over the wheels 56. The cartons 14 rest on the endless belts 52, 54 and are propelled through the skew station 16, the glue station 18, the folding station 22 and the kicker station 24. As the cartons travel through the stations, a first side 60 and a second side 62 of the carton 14 define first and second boundary lines 64, 66, respectively.

The encoder 36 can be a wheel 68 in contact with the rotating conveyor belt 54. To obtain one pulse per inch of movement, the wheel could have a 12" circumference and provide 12 pulses per rotation, for example, an ACCU-CODER 711-S manufactured by Encoder Products.

Figure 3B:
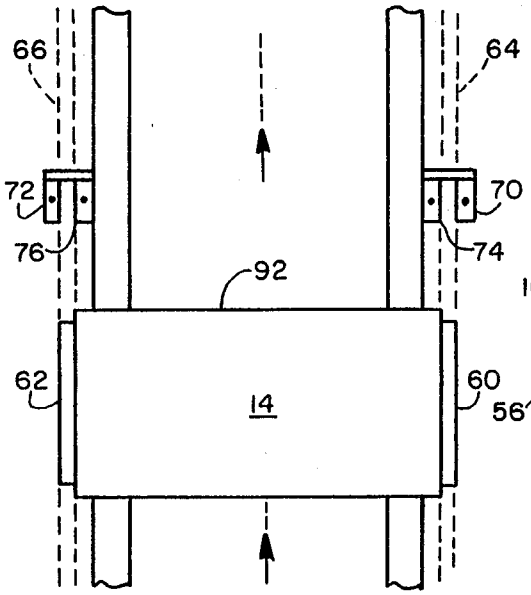
FIG. 3B is a plan view of the skew station.

FIG. 3B shows a plan view of the skew station 16 which includes first and second skew sensors 70, 72 both located outside the first and second boundary line 64, 66, respectively. The skew station 16 also includes first and second align sensors 74, 76 located inside the boundary lines 64, 66. While the skew sensors 70, 72 are physically located outside the boundary lines in FIGS. 3A and 3B, the skew sensors can be located inside or outside the boundary lines 64, 66 as long as the skew sensors 70, 72 are directed to sense outside the boundary lines. The align sensors can also be located inside or outside the boundary lines 64, 66 as long as the sensors are directed to sense inside the boundary lines 64, 66.

The skew sensors 70, 72 and align sensors 74, 76 can be WT-10 sensors manufactured by SICK Optic Electronics, Inc. The skew sensors 70, 72 are triggered if the carton 14 is skewed such that either sides 60, 62 of the carton 14 are displaced outside the boundary lines 64, 66. The first and second skew sensors 70, 72 provide a first and second skew signal, respectively, when triggered by the carton 14. The output of the skew sensors 70, 72 and the align sensors 74, 76 are input to a processor 80 and I/O circuit 81 located in housing 82. If the skew signals are generated, the I/O circuits 81 activate the kicker station 24 when the carton 14 is aligned therewith.

When the carton 14 exits the skew station 16, the carton 14 enters the glue station 18. The glue station 18 includes an ultra-violet (UV) source 86, a UV sensor 88, a start sensor 89 and a stop sensor 90. The UV sensor 88 senses the fluorescent material in the glue strip 19 which is illuminated by the UV source 86. The start sensor 89 and the UV sensor 88 are positioned such that as the start sensor 89 senses the front edge 42 of the carton 14, the UV sensor 88 senses a leading edge 91 of the glue strip 19. The stop sensor 90 is positioned to sense the rear edge 92 of the carton 14 before the UV sensor 88 stops sensing the fluorescent material. The UV sensor 88, start sensor 89, stop sensor 90 and the I/O circuits 81 determine if glue has been properly applied to the carton 14. If glue has been improperly applied, the kicker station 24 is activated when the carton 14 is aligned therewith.

Figure 3C:
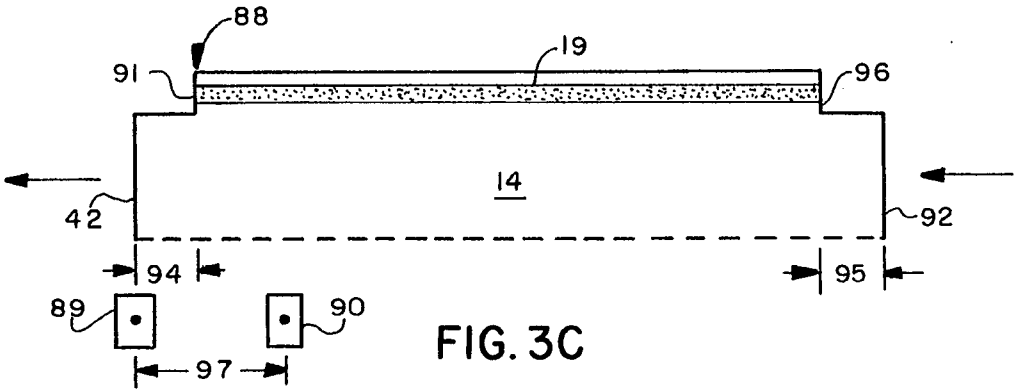
FIG. 3C is a plan view of the location of the start and stop sensors of the glue station.

In FIG. 3C, the physical spacing of the start sensor 89, stop sensor 90 and UV sensor 88 is shown. A distance 94 between the front edge 42 and the leading edge 91 of the glue strip 19 is A inches. A distance 95 between a trailing edge 96 of the glue strip 19 and the rear edge 92 is B inches. A distance 97 between the start sensor 89 and the stop sensor 90 is C inches where $C=(A+B)$. Note that the leading edge 91 is sensed by the UV sensor 88 before or just as the start sensor 89 senses the front edge 42 and that the stop sensor 90 senses the rear edge 92 before the UV sensor 88 stops sensing glue.

After exiting the glue station 18, the carton 14 proceeds to the folding station 22 where the carton is folded and then to the kicker station 24 which includes a kicker 100 having a kick arm 102 controlled by a solenoid (not shown).

After the cartons exit the kicker station 24, the cartons 14 are stacked and pressure is applied thereto to allow the glue to dry. If a skewed carton 14 or a carton 14 with glue incorrectly applied are detected, the kicker arm 102 bumps the front edge 42 or the rear edge 92 of the folded carton 98 such that the rejected carton sticks out of the stack and an operator can remove the rejected carton from the stack.

Figure 4A:
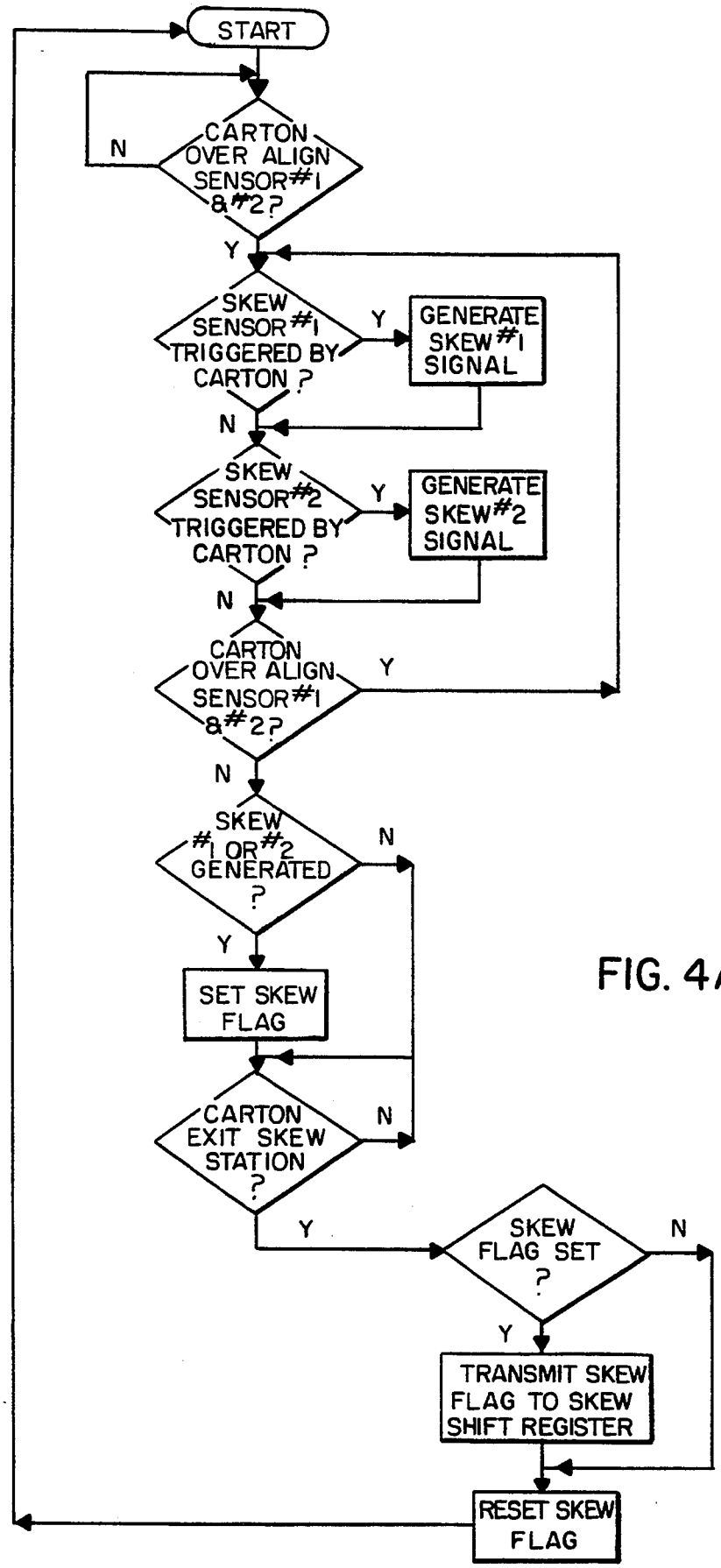
FIG. 4A is a logic diagram of the operation of the input circuit skew station.
Figure 4B:
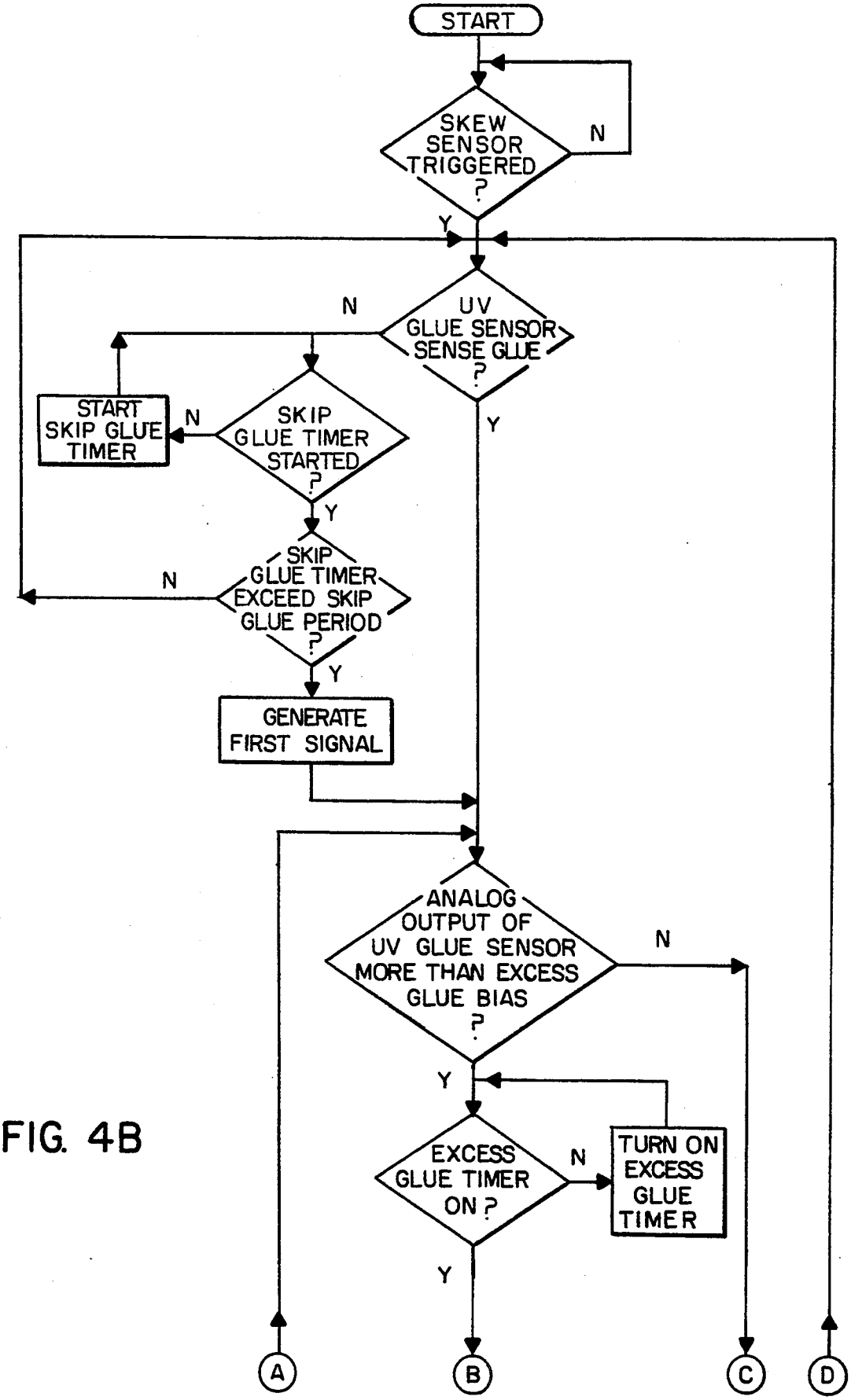
FIG. 4B is a logic diagram of the glue input circuit.
Figure 4B:
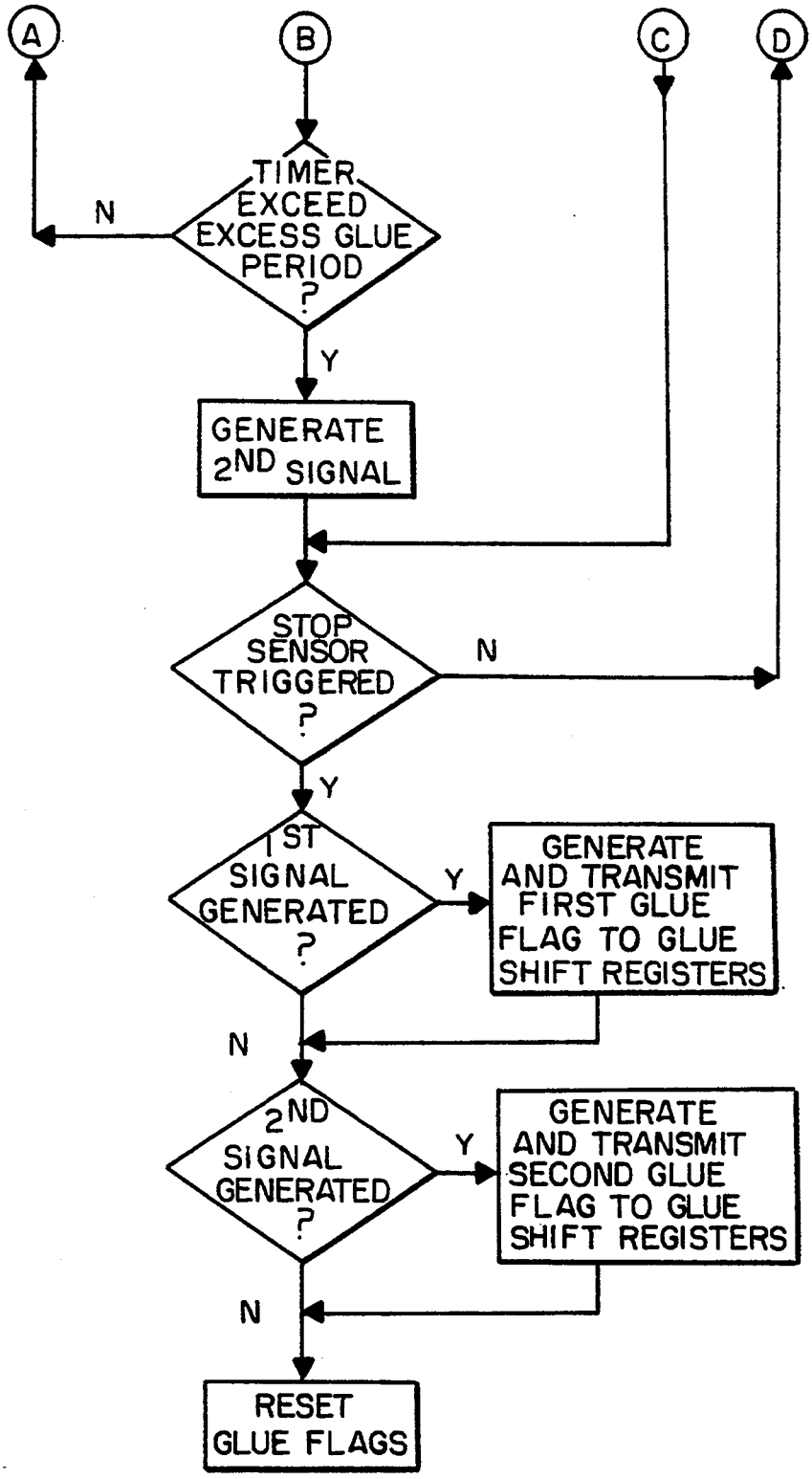
Figure 4C:
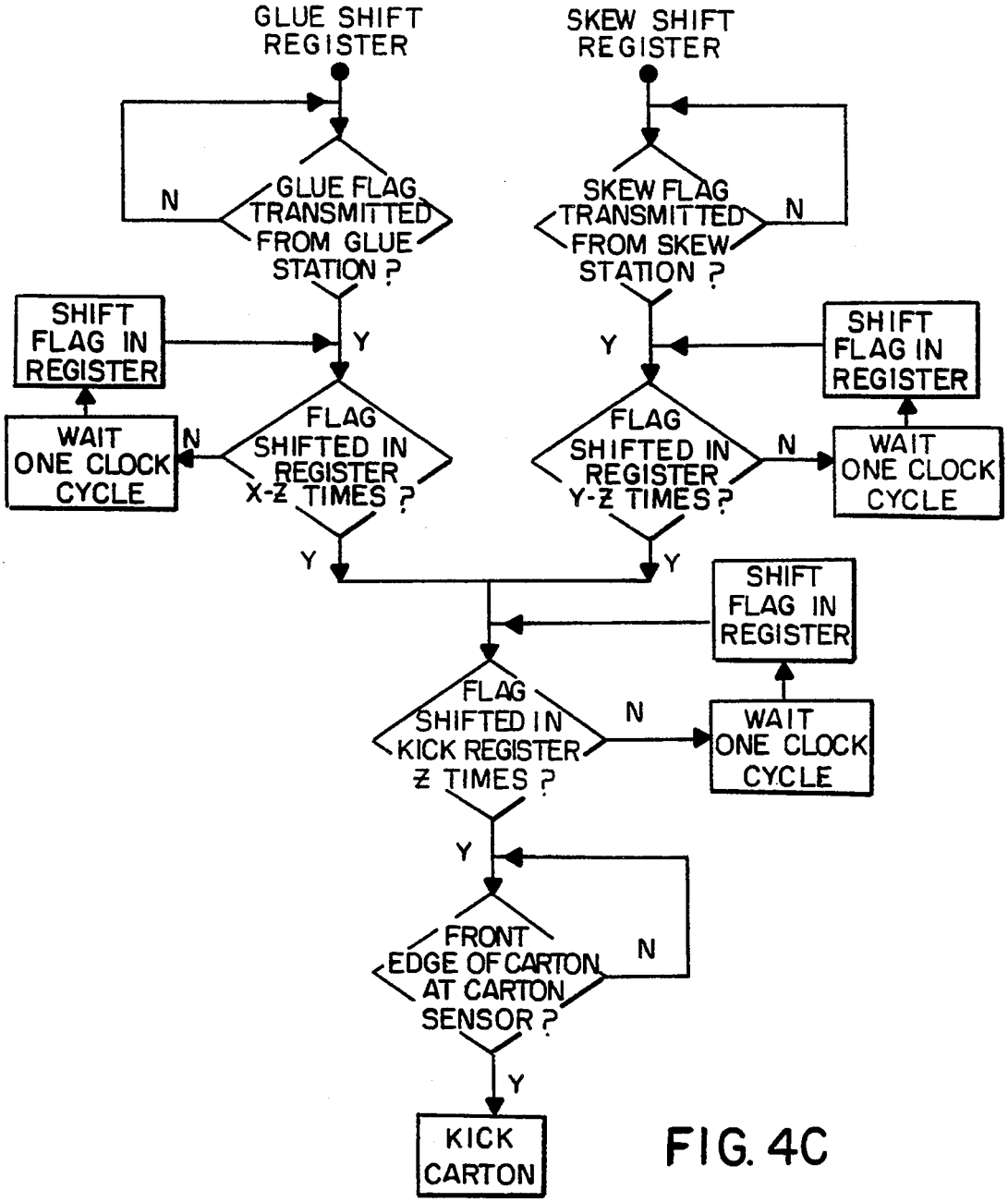
FIG. 4C is a logic diagram of the operation glue shift register and skew shift register.
Figure 5A:
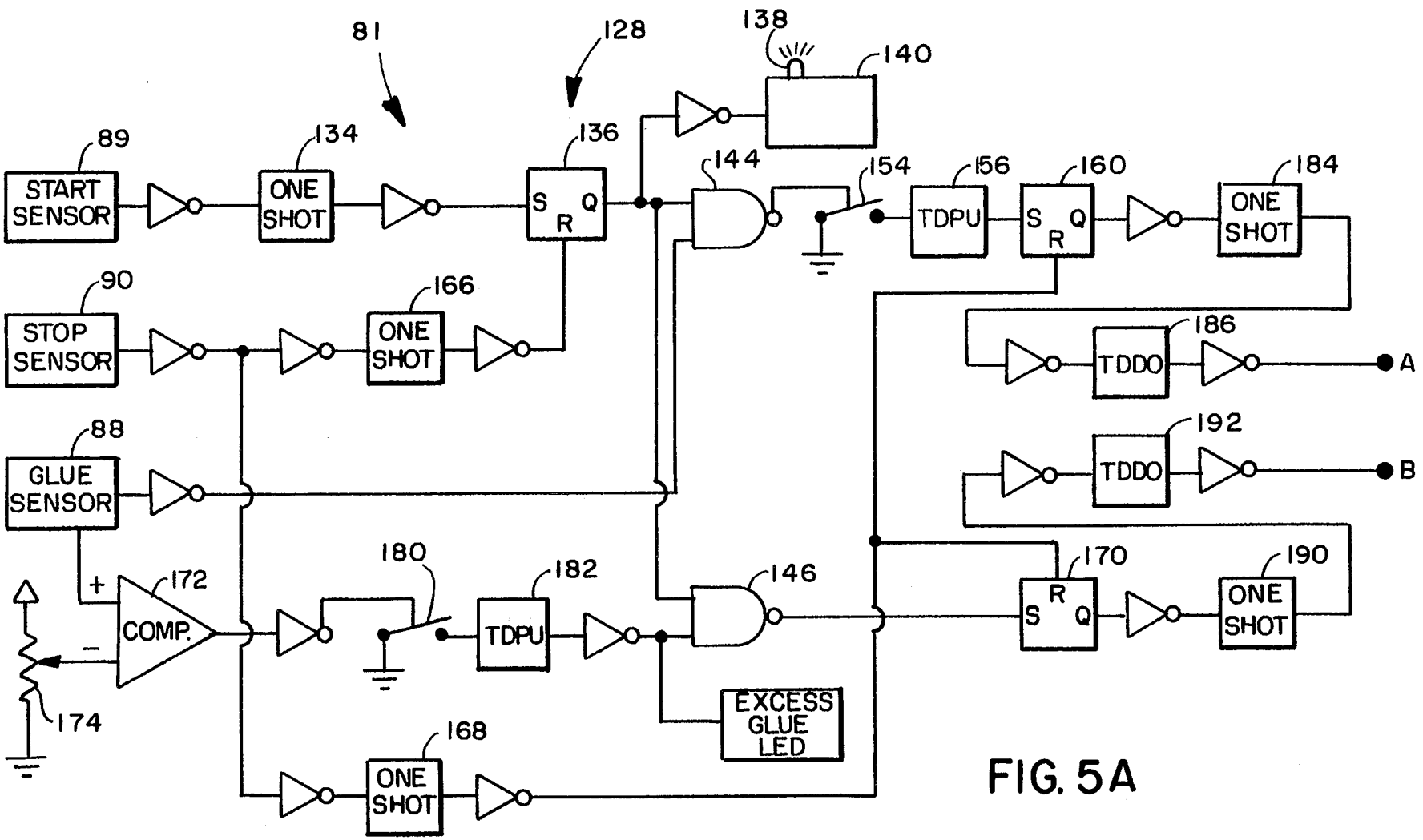
FIG. 5A is an electrical schematic of the glue input circuit.
Figure 5B:
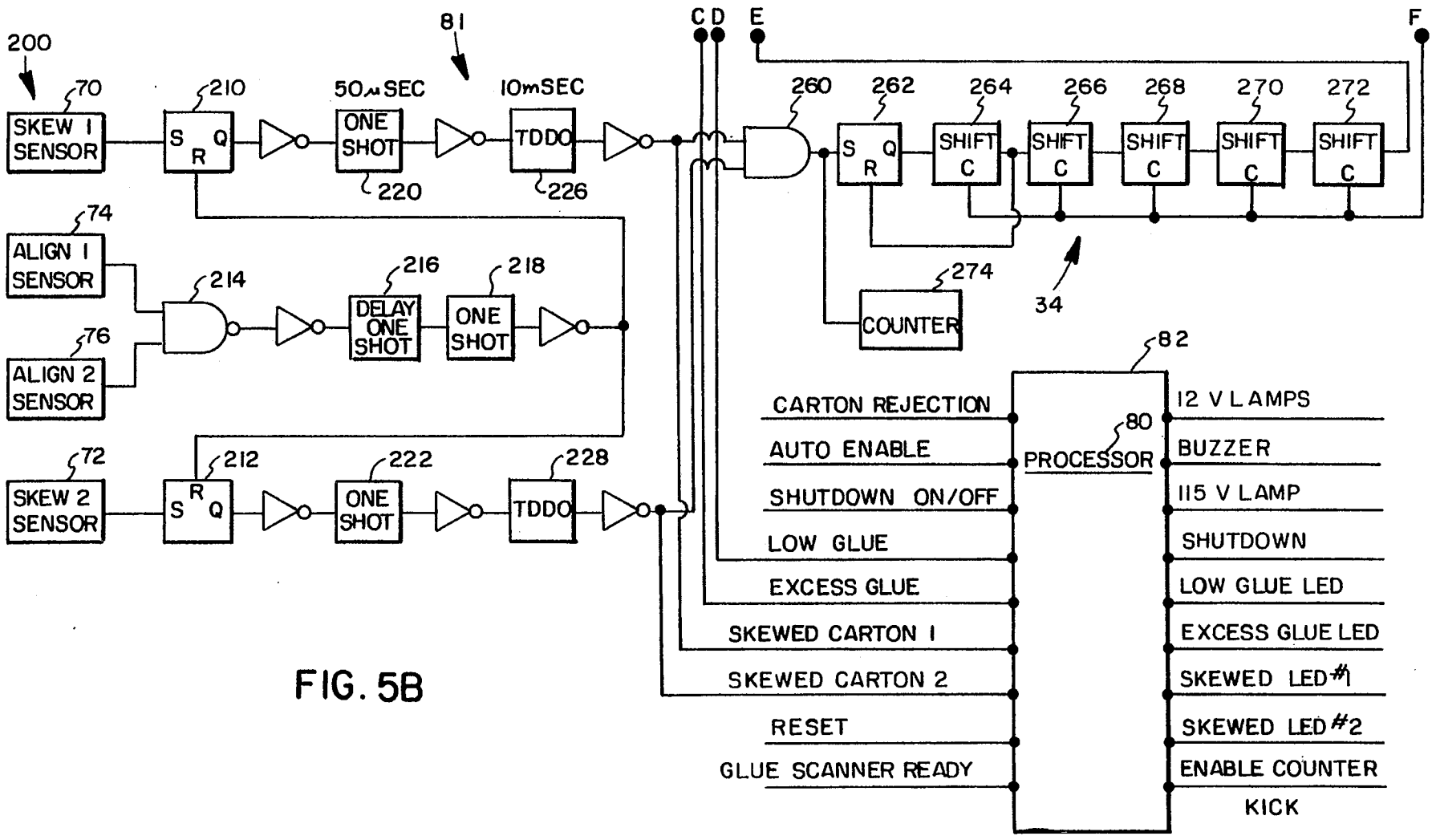
FIG. 5B is an electrical schematic of the skew station input circuit, the skew shift register, and the processor.
Figure 5C:
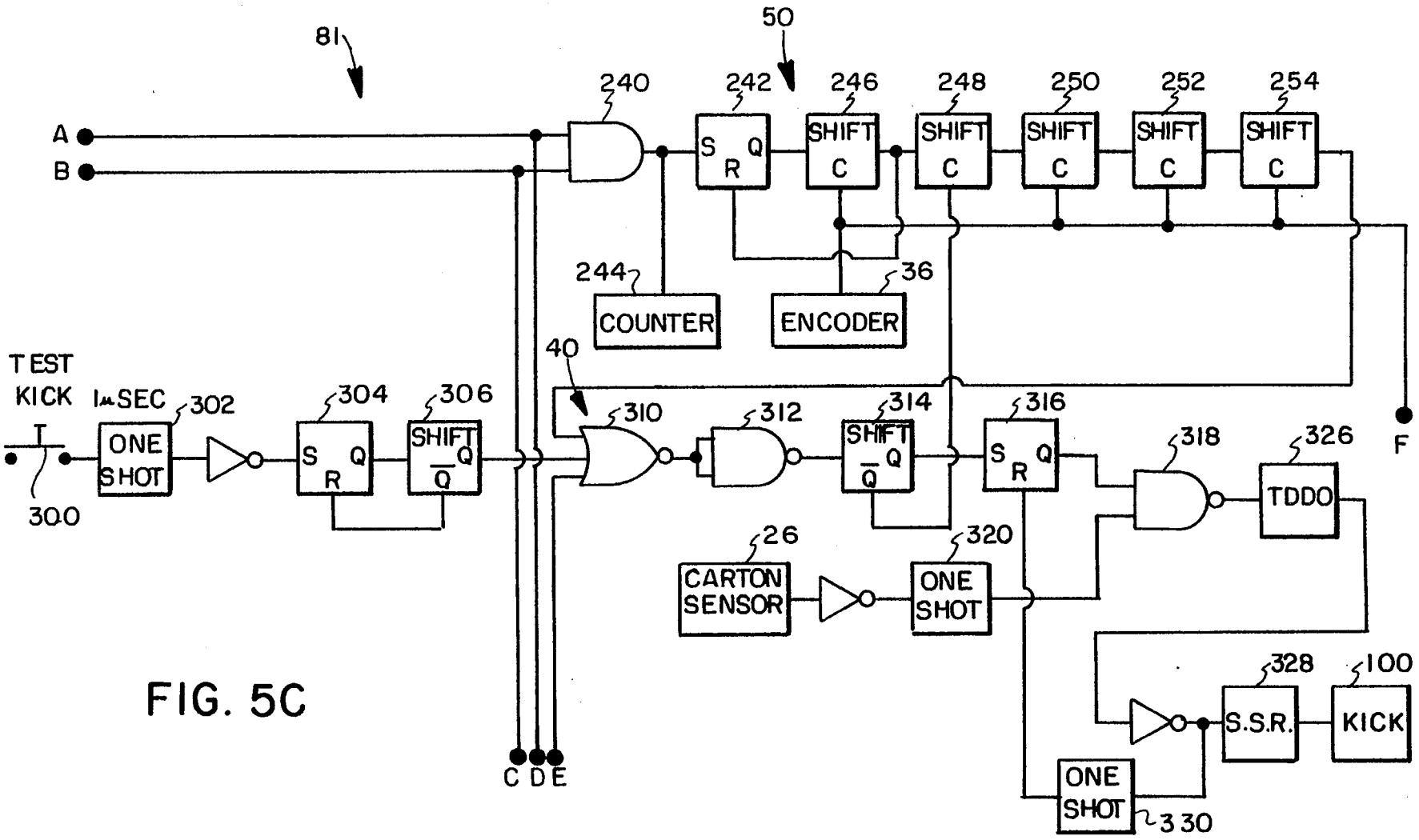
FIG. 5C is an electrical schematic of the glue shift circuit, the test kick circuit, and the kick shift register.

FIGS. 4A, 4B and 4C show the logic structure of the hard wired I/O circuit 81 shown in FIGS. 5A, 5B and 5C. FIG. 5A shows a glue input circuit 128 for the glue station 18. When the start sensor 89 senses the front edge 42 of the carton 14, a monostable 134 sets a latch 136. A Q output of the latch 136 turns on a monitoring LED 138 on a panel 140. The Q output of the latch 136 is also input to a NAND gate 144 and a NAND gate 146. The start sensor 89 is positioned with respect to the UV sensor 88 such that the start sensor 89 senses the front edge 42 of the carton as the UV sensor 88 senses a leading edge 91 of the glue strip 19.

Preferably, the UV sensor 88 has two outputs. A first digital output is either high or low depending upon a level of the fluorescent material detected and a threshold level selectably set using a turn screw, internal jumper, etc. The second output is an analog output proportional to the luminescence detected. The UV sensor 88 could be a LUT 1-4 manufactured by SICK Optic Electronics, Inc.

The output of the UV sensor 88 is also input to the NAND gate 144. When the UV sensor 88 does not sense glue and the start sensor 89 has already sensed the front edge 42, the output of the NAND gate 144 is low, the CMOS switch 154 is closed and a time delay pick-up (TDPU) 156 is activated. The TDPU 156 includes an adjustment which sets the delay between 1–50 milliseconds. If the CMOS switch 154 stays closed for longer than a skip glue period, set in the TDPU 156, the TDPU 156 provides a first signal to set a latch 160. Upon receiving the first signal from the TDPU 156, a Q output of the latch 160 goes high and remains high until reset. The latch 160 is reset when the stop sensor 90 senses the rear edge 92 of the carton 14. When the stop sensor 90 senses the rear edge 92 of the carton 14, a monostable 166 resets the latch 136 and a monostable 168 resets the latch 160 and a latch 170. When the latches 160, 170 are reset, their outputs go low.

The UV sensor 88 provides the analog output of 50–1,000 millivolts which is input to a non-inverting input of a comparator 172. A potentiometer 174 biases an inverting input of the comparator 172. If the analog voltage from the UV sensor 88 is higher than a voltage set by the potentiometer 174; an output of the comparator 172 will close a CMOS switch 180. The bias of the potentiometer corresponds to excess glue application, e.g., the glue strip is too wide or thick. If the CMOS switch 180 is closed longer than an excess glue period set by a TDPU 182, the TDPU 182 will provide a pulse input to the NAND gate 146 causing the NAND gate 146 to change states and set the latch 170.

The latches 160, 170 allow only one pulse output per bad carton. When the latches 160, 170 reset when the stop sensor 90 senses the rear edge 92 and the latches 160, 170 had been previously set due to insufficient or excess glue, the latches 160, 170 provide a first and second glue flag, respectively (e.g., Q outputs go low). When the Q output of the latch 160 goes low and generates the first glue flag due to glue skip, a monostable 184 transmits the glue flag to a time delay drop out (TDDO) 186. The TDDO 186 holds the glue flag for ten milliseconds and then outputs the glue flag to the glue shift register 50. The TDDO 186 is required due to a scan time of the processor 80. The monostable 184 is required to accommodate a situation in which a successive carton is close to the preceding carton and the latch 160 is set in less than ten milliseconds. Monostable 184 and TDDO 186 similarly transmit the glue flag due to excess glue to the glue shift register 50.

The skew input circuit 200 in FIG. 5B includes the skew sensors 70, 72 and the align sensors 74, 76. The skew sensors 70, 72 are connected to latches 210, 212, respectively. When the skew sensor 70 provides a first skew signal, the latch 210 is set and a Q output of the latch 210 goes high. The latches 210, 212 hold the skew signals until the carton exits the skew station 16. After the alignment sensors 74, 76 sense the rear edge 92 of the carton 14, the sensors 74, 76 turn on an output of a NAND gate 214 which activates a 500 microsecond delay monostable 216. The monostable 216 in turn triggers a 50 microsecond monostable 218 which resets the latches 210, 212. When the latches 210, 212 are reset after previously being set by the skew sensors 70, 72, the latches 210, 212 output a first and second skew flags, respectively, which activate the 50 microsecond monostables 220, 222, which in turn activate a ten millisecond TDDO 226, 228. The first and/or second skew flag(s) transmitted by the TDDO 226, 228 are input to the skew shift register 34. The alignment sensors 74, 76 hold a skewed condition until the carton exits the skew station 16.

The glue shift register 50 in FIG. 5C includes an AND gate 240. The output of the AND gate 240 is held high until a glue flag is received from the glue input circuit 128. The AND gate 240 allows only one glue flag per carton 14. Upon receiving a glue flag, the AND gate 240 goes low and sets a latch 242. The Q output of the latch 242 is input to a shift register 246. The encoder 36 provides timing pulses to the register 246 to shift the glue flag to a register 248. The output of the register 246 simultaneously resets the latch 242. Registers 250, 252, 254 are variable length registers. The number of registers, for example Y-Z registers, corresponds to a distance between the exit of the glue station 18 and the entrance to the kicker station 24 minus the carton length Z. Output from the last shift register 254 is input to the kick shift register 40.

The skew shift register 34 includes an AND gate 260, a latch 262 and shift registers 264, 266, 268, 270 and 272. The skew shift register 34 operates similar to the glue shift register 50. However, the variable registers 266, 268, 270, 272 include X-Z registers which corresponds to a physical distance between the exit of the glue station 18 and the entrance to the kicker station 24 minus the carton length Z. A counter 274 records skew flags.

The output of the TDDOs 186, 192 from the glue input circuit 128 are input to the processor 80. The output of the TDDO 226, 228 from the skew input circuit 200 are also input to the processor 80. The processor 80 controls the display LEDs, various lamps, buzzers, etc.

A test kick switch 300 is utilized for setting up and testing the kicker 100. When the switch 300 is closed, the switch triggers a one millisecond monostable 302 which sets a latch 304. The Q output of the latch 304 is input to a shift register 306. After one clock cycle input from the encoder 36, the Q output of the shift register 306 turns on and the inverse Q output resets the latch 304.

The kick shift register 40 includes a NOR gate 310 having a normally high output. When the NOR gate 310 receives the glue flag from the shift register 254, the skew flag from the shift register 272 or a test kick flag from the shift register 306, the output of the NOR gate 310 goes low and is input to a NAND gate 312. The output of the NAND gate 312 transmits the flag to a variable length shift register 314 which is set according to the length of the carton 14 to be kicked. For example, the shift register 314 can have a range of 15–0 shifts or inches. For each inch of the carton, one inch must be subtracted from 15. For example, a carton of 12 inches would need 15–12=3 shifts. If the carton is longer than 15 inches, ten shifts can be taken off every shift circuit, e.g., the glue shift circuit and the skew shift circuit to make a range of 25–10 inches. Thus, if a carton had a length of 23 inches, the shift register 314 would be set to 2.

After the shift register 314 shifts through a number of shifts required for the carton length, the inverse Q output of the register 314 sets a latch 316. The Q output of the latch 316 is input to a NAND gate 318. When the carton sensor 26 senses the front edge 42 of the carton 14, the carton sensor 26 triggers a monostable 320 which provides an input to the NAND gate 318. If the latch 316 was set by a flag and the monostable 320 was triggered by the carton sensor 26, the NAND 318 gate goes low and triggers a TDDO 326 which is adjustable from 10–100 milliseconds. The output of the TDDO 326 activates a solid state relay 328 for the kicker 100 and resets the latch 316 through a monostable 330.

Figure 6A:
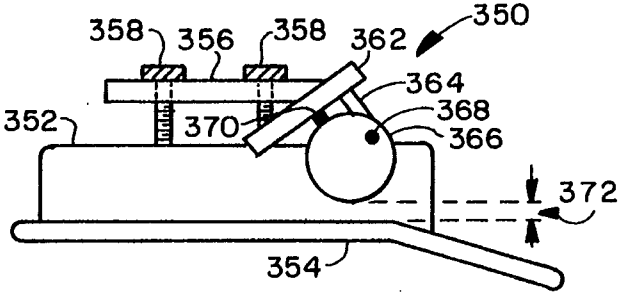
FIG. 6A is a plan view of the double carton check station.

FIG. 6A shows a double carton check station 350 including a base 352, a guide 354 and an adjustable height support 356 supported by bolts 358. The adjustable support 356 includes a first arm 362 and a second arm 364. The second arm has a cylinder 366 rotatingly secured thereto on an offset axis 368. The first arm 362 includes a microswitch 370 and a clearance 372 is defined by a lower portion of the cylinder 366 and the guide 354. The base is attached to the conveyor 12 such that a first or second side 60, 62 of the cartons 14 pass through the clearance 372. The support 356 is adjusted to define the clearance 372 such that a single carton will pass therethrough without moving the cylinder 368 into the microswitch 370. If two cartons stacked on each other pass through the clearance 372, the cylinder 366 is bumped against the microswitch 370 when the front edge 42 of the cartons enters the doubles checking station 350.

Figure 6B:
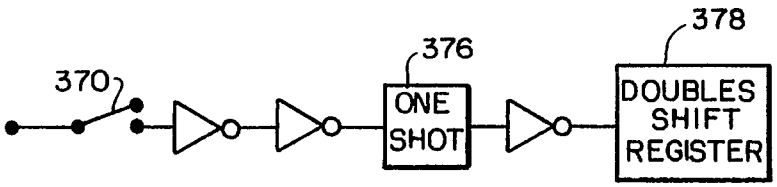
FIG. 6B is an electrical schematic of the double carton check circuit.

The switch 370 (see FIG. 6B) is closed until the rear edge 92 passes the doubles checking station 350. When the switch 370 opens, a monostable 376 provides a doubles flag to a doubles shift register 378. A doubles shift register 378 includes D registers where D is proportional to the encoder 36 rate and a distance between the switch 370 and the entrance of the kicker station 24 minus the carton length Z. Note that since the switch remains closed until the stacked cartons leave the double check station 350, only one doubles flag will occur per stacked carton.

Figure 7A:
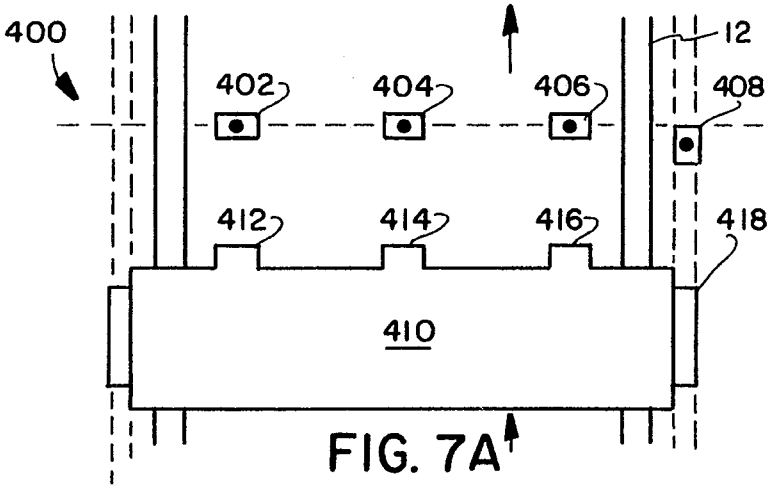
FIG. 7A is a plan view of the flap check station.

FIG. 7A shows a flap check station 400 having a first flap sensor 402, a second flap sensor 404, a third flap sensor 406 and a flap timing sensor 408. A carton 410 includes a first flap 412, a second flap 414 and a third flap 416. As the carton 410 moves on the conveyor 12, a side flap 418 triggers the flap timing sensor 408. If the flaps 412, 414 and 416 are not bent backwards or torn off, the flaps 412, 414, 416 should simultaneously trigger the flap sensors 402, 404, 406, respectively.

Figure 7B:
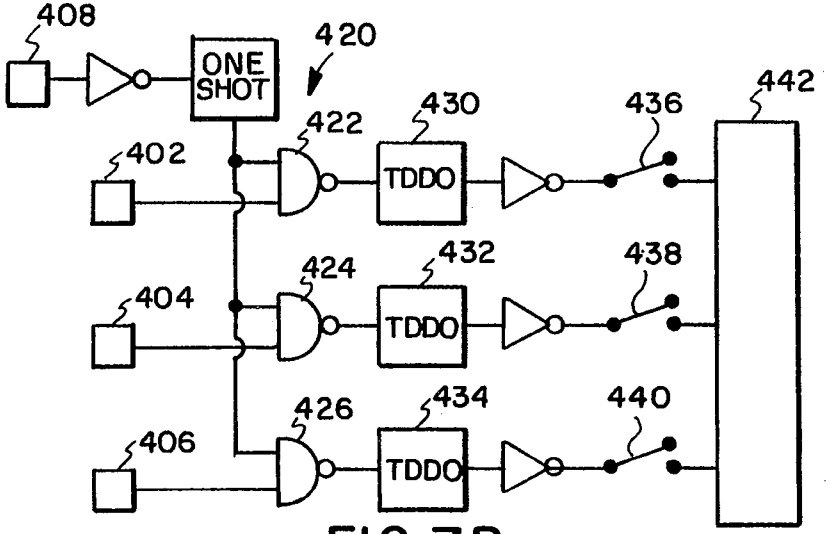
FIG. 7B is an electrical schematic of the flap check circuit.

In FIG. 7B, a flap check circuit 420 is shown. When the side flap 418 triggers the flap timing sensor 408, a monostable provides a 50 microsecond flap timing pulse to a first NAND gate 422, a second NAND gate 424, and a third NAND gate 426. The flap sensors 402, 404, 406 should simultaneously provide a pulse to the NAND gates 422, 424, 426, respectively, during the flap timing pulse from the flap timing sensor 408. If any of the flap sensors 402, 404, 406 do not sense the flaps 412, 414, 416, the output from the NAND gate 422, 424, 426 from the associated sensor triggers 10 millisecond TDDO 430, 432, 434 which provide a first, second or third flap flag. Switches 436, 438 and 440 enable the output from flap check sensors 402, 404, 406, respectively, to be output to a flap shift register 442. The flap shift register 442 includes F registers where F is proportional to the encoder 36 rate and a distance between the flap sensors and the entrance to the kicker station 24. Since the flaps are checked at the front of the carton, the carton length is not subtracted from F.

Figure 8B:
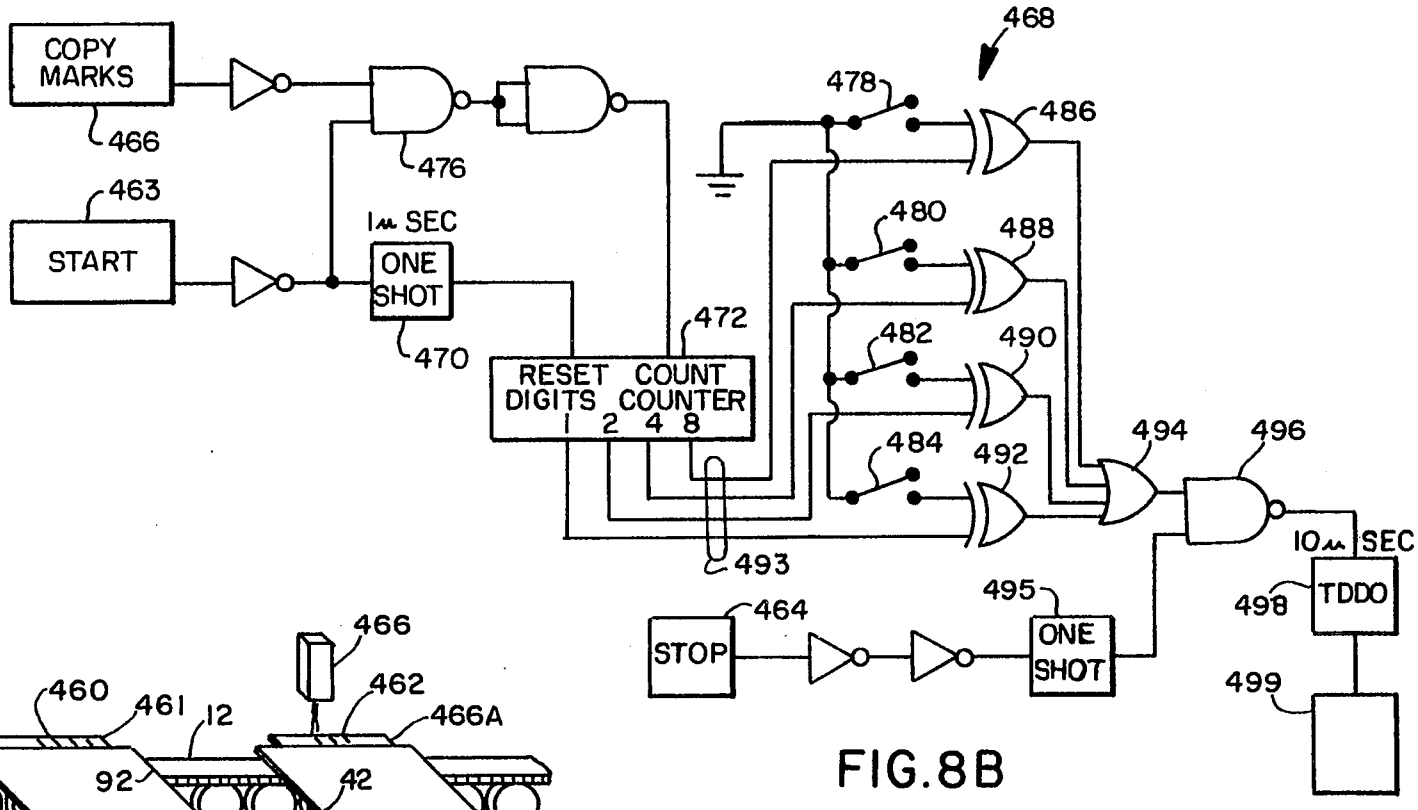
FIG. 8B is an electrical schematic of the wrong copy check circuit.
Figure 8A:
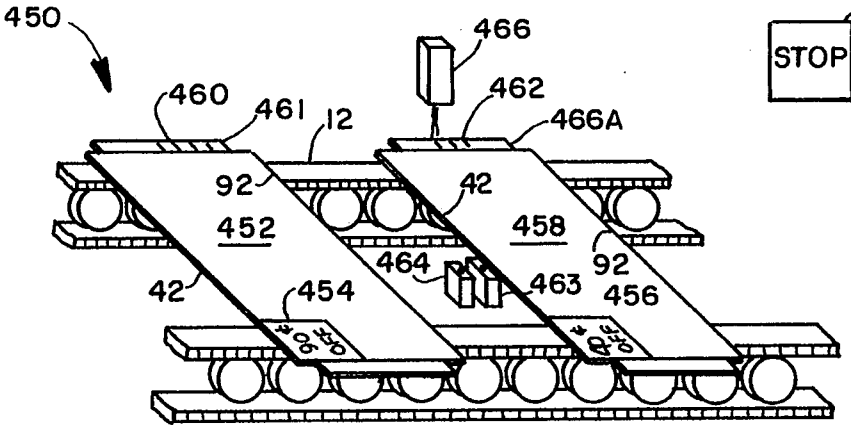
FIG. 8A is a perspective view of the wrong copy check station.

FIG. 8A shows a wrong copy station 450 which is used to check cartons having the same size and style but different printing. For example, a carton 452 has printed information 454 different from printed information 456 on a carton 458. To accomplish the above, the carton 452 is provided with markings 460, for example, four marks on a flap 461 thereof, while the carton 458 has markings 462, for example, three marks on a flap 466A thereof. The wrong copy check station 450 includes a start sensor 463, a stop sensor 464, and a copy mark sensor 466.

FIG. 8B shows a wrong copy circuit 468. When the start sensor 463 senses the front edge 42 of the carton 458, a one millisecond monostable 470 resets a first counter 472. A tens counter (not shown) could also be used if additional marks are desired. The copy mark sensor 466 and the start sensor 463 are also input to a NAND gate 476. The copy mark sensor 466 sends a pulse to the counter 472 for each mark on the flap 463 after said start sensor senses front edge 42 and before said start sensor senses said rear edge 92. The flap check circuit 468 includes a first switch 478, a second switch 480, a third switch 482 and a fourth switch 484 each connected to a first exclusive OR (X-OR) gate 486, a second X-OR gate 488, a third X-OR gate 490 and a fourth X-OR gate 492. An actual count signal output by the counter 472 on lines 493 corresponds to the number of marks sensed by the copy mark sensor 466 in binary. The switches 478, 480, 482, 484 are either opened or closed depending upon a desired count representing the number of marks expected on the carton 458. If the actual count from the counter 472 does not match the desired count set by the switches 478, 480, 482 and 484, at least one of the X-OR gates 486, 488, 490 and 492 will go high and the output of an OR gate 494 will also go high. If the output of the OR gate 494 is high when the stop sensor 464 senses the rear edge 92 of the carton 458 and triggers a monostable 495, a NAND gate 496 will reset a 10 millisecond TDDO 498 and provide a wrong copy flag to a wrong copy shift register 499. The wrong copy shift register 499 includes W registers wherein W is proportional to the encoder 36 rate and to a distance between an exit of the wrong copy check station 450 (e.g., the stop sensor 464) and the entrance to the kicker station 24 minus the carton length Z.

Figures 9A, 9B:
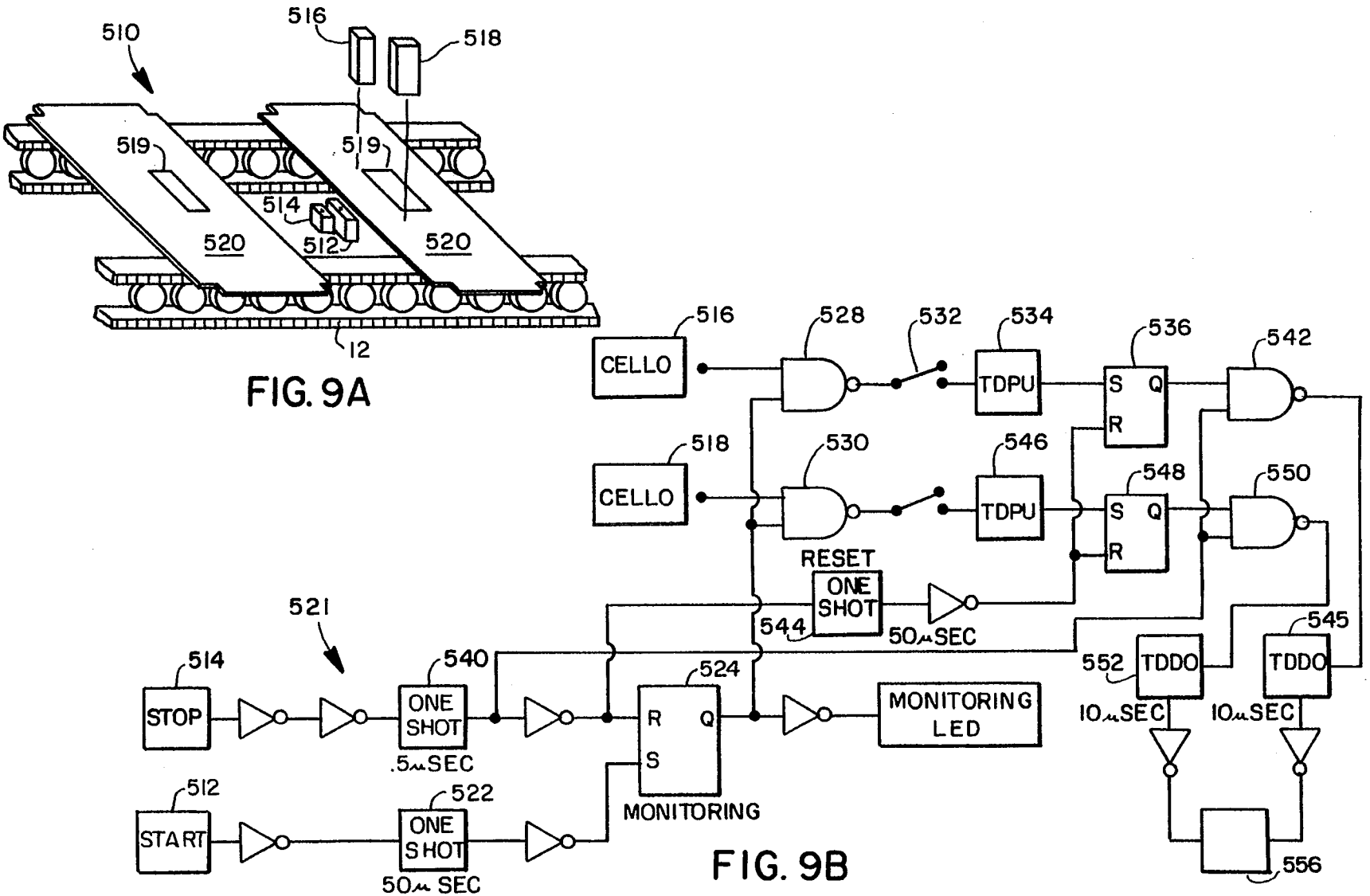
FIG. 9A is a perspective view of the insert check station.
FIG. 9B is an electrical schematic of the insert check circuit.

FIG. 9A shows a insert check station 510 including a start sensor 512, a stop sensor 514, a first insert sensor 516 and a second insert sensor 518. The insert check station 510 checks for both sides of a rectangle of insert 519 being glued to a side of a carton 520. The insert sensors can be NT-6 or NT-8 sensors manufactured by SICK Optic Electronics, Inc. Note that these sensors can detect a coupon, cellophane, etc. to be glued to a carton.

FIG. 9B shows an electrical schematic of an insert check circuit 521. When the start sensor 512 senses the front edge 42 of the carton 520, a 50 microsecond monostable 522 sets a monitoring latch 524. Simultaneously, the first and second insert sensors 516, 518 must sense the insert 519. The Q output of the monitoring latch 524 is input to a first and second NAND gate 528, 530. If the first insert sensor 516 does not sense insert the output of the NAND gate closes a CMOS switch 532. If the CMOS switch 532 remains closed longer than a setting on a TDPU 534, the TDPU 534 sets the latch 536. When the stop sensor 514 senses the rear edge 92 of the carton, a 0.5 millisecond monostable 540 resets the monitoring latch 524 and provides an input to a NAND gate 542. The monostable 540 also triggers a monostable 544 which resets the latch 536. The latch 536 provides an input to the NAND gate which triggers a 10 millisecond TDDO 545 which generates a first insert flag if the latch 536 was previously set. A TDPU 546, a latch 548, a NAND gate 550, and a TDDO 552 associated with the second insert sensor 518 operate similarly to generate a second insert flag. The first and second insert flags are output to a insert shift register 556 having C registers where C is proportional to the encoder 36 rate and a distance between the exit of the insert check station 510 (e.g., the stop sensor 514) and the entrance to the kicker station 24 minus the carton length Z.

Figures 10A, 10B:
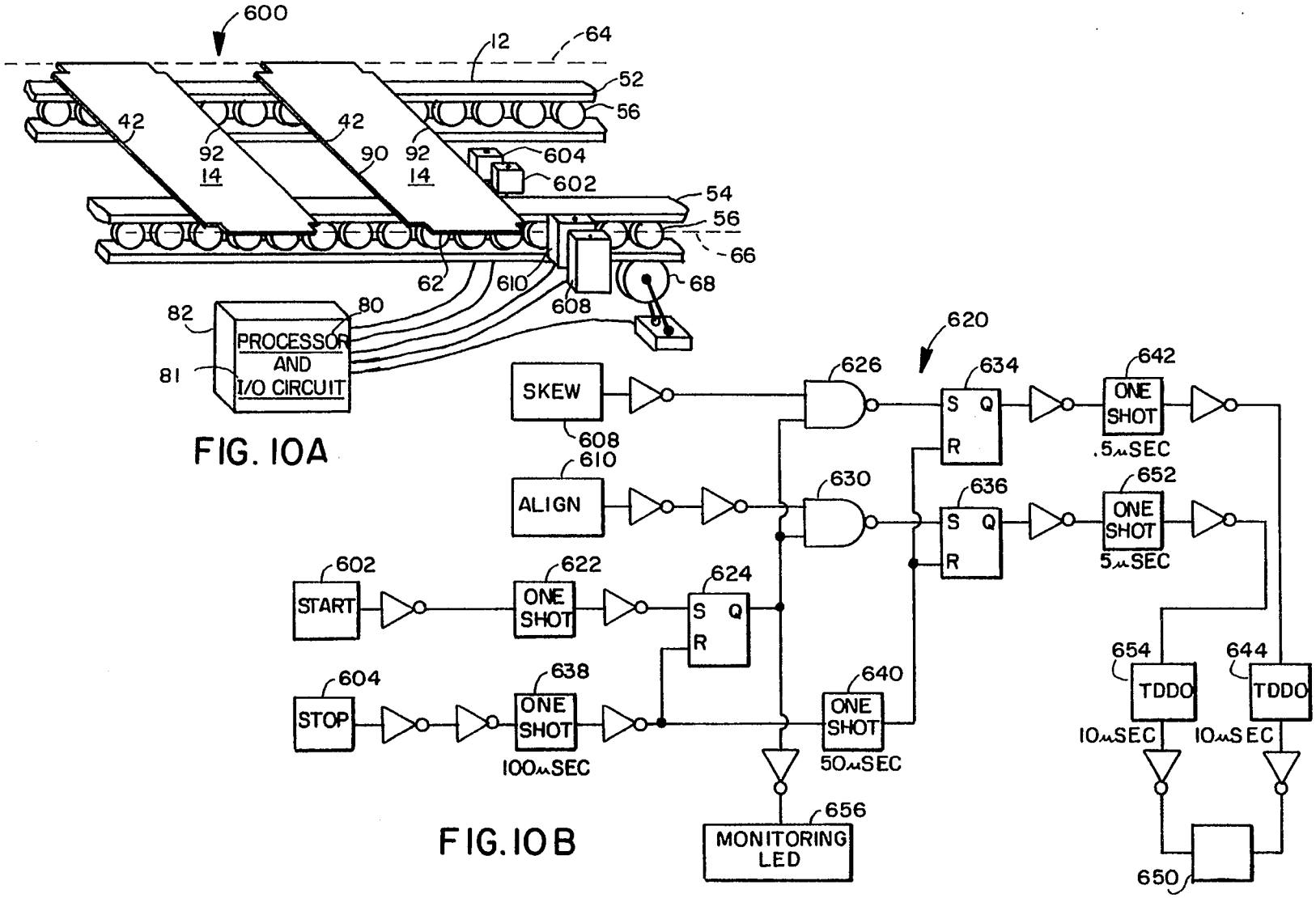
FIG. 10A is a perspective view of an alternate skew station.
FIG. 10B is an electrical schematic of the alternate skew station input circuit.

FIG. 10A shows an alternate skew station 600 including a start sensor 602, a stop sensor 604, a skew sensor 608 and an align sensor 610. The alternate skew station 600 detects if the carton 14 is properly located between the first and second boundary lines 64, 66 using only one align sensor 610 and one skew sensor 608.

FIG. 10B shows an electrical schematic of an alternate skew station circuit 620. When the start sensor 602 senses the front edge 42 of the carton 14, the start sensor 602 triggers a 50 microsecond monostable 622 which sets a monitoring latch 624. A Q output of the monitoring latch 624 is input into a first and second NAND gate 626, 630, respectively. If the skew sensor 608 located outside boundary line 66 senses the edge 62 of the carton 14, the NAND gate 626 will set a latch 634. If the align sensor 610 does not sense the carton 14 while the monitoring latch is on (e.g., after the start sensor 602 sets the latch 624 and before the stop sensor resets the latch 624), the NAND gate 630 will output and set a latch 636. The align sensor 610 therefore senses if the carton is skewed across boundary line 64 while the skew sensor 608 senses if the carton 14 has skewed across the boundary line 66.

When the stop sensor 604 senses the rear edge 92 of the carton 14, the stop sensor 604 triggers a 100 microsecond monostable 638 which resets the latch 624 and triggers a 50 microsecond monostable 640 to reset the latches 634, 636. If the Q output of the latch 634 is high, a 50 microsecond monostable 642 resets a 10 millisecond TDDO 644 which transmits the alternate skew flag from the latch 634 to an alternate skew shift register 650. Monostable 652 and a 10 millisecond TDDO 654 similarly transmit an alternate skew flag from the latch 636 to the alternate skew shift register 650. A monitoring LED 656 is connected to the Q output of the latch 624 to indicate that the alternate skew station 600 is monitoring a carton.

While detailed circuits have been disclosed herein, modification will be readily apparent.

We claim:

1. In a carton glue monitoring system including a conveyor line moving a plurality of cartons in a first direction, glue having a fluorescent material added thereto, a glue applicator applying the glue to the cartons, and a glue check station including a UV source for illuminating the fluorescent material in the glue and a UV sensor located adjacent the UV source for sensing the illuminated fluorescent material and for providing a glue signal while said UV sensor senses said illuminated fluorescent material, the improvement comprising:

start means for sensing a front edge of the carton as said UV sensor senses a leading edge of said glue;

stop means for sensing a rear edge of the carton before said UV sensor stops sensing said glue;

first timing means connected to said UV glue sensor and said start sensing means and reset when said start sensing means senses said front edge, said first timing means for providing a first signal if said first timing means reaches a skip glue period before said UV glue sensor senses said leading edge of said glue, said timing means being reset when said UV glue sensor senses said leading edge of said glue;

glue flag means connected to said start sensing means, said UV sensor, said stop sensing means and said first timing means for generating a first glue flag if said glue flag means receives said first signal before said stop sensing means senses a rear edge of the carton and for transmitting said glue flag to a glue shift register when said stop sensing means senses said rear edge; and means connected to said glue flag means for indicating said first glue flag.

2. The carton glue monitoring system of claim 1 further including:

comparing means including biasing means for providing an excess glue bias, said comparing means for comparing an analog output of said UV sensor with the excess glue bias and for providing an excess glue signal; and second timing means connected to said stop sensing means, said comparing means and said glue flag means for providing a second signal if said comparing means provides said excess glue signal longer than an excess glue period before said stop sensing means senses said rear edge;

wherein said glue flag means generates a second glue flag if said sensing means receives said second signal and transmits said second glue flag to said glue shift register when said stop sensing means senses said rear edge of the carton, and wherein said indicating means indicates said second glue flag.

3. The improved carton glue monitoring system of claim 2 wherein said first timing means includes a first latch set when said start sensing means senses said front edge, and reset when said stop sensing means senses said rear edge, and wherein a Q output of said first latch and said glue signal from said UV sensor are input to a first NAND gate.

4. The improved carton glue monitoring system of claim 3 wherein said first timing means includes a first TDPU and a first switch connected to an output of said first NAND gate, said first switch being closed when said output of said first NAND gate is high, said first TDPU generating said first signal if said first switch remains closed longer than said skip glue period.

5. The improved carton glue monitoring system of claim 4 wherein said glue flag means includes a second latch being reset when said stop sensing means senses said rear edge of the carton and generating said first glue flag when reset if said second latch was set by said first signal.

6. The improved carton glue monitoring system of claim 5 wherein said comparing means is a comparator and said biasing means is a potentiometer biasing an inverting input of said comparator, and wherein said analog output of said UV glue sensor biases a non-inverting input of said comparator.

7. The improved carton glue monitoring system of claim 6 wherein said second timing means includes a second NAND gate having an input connected to the Q output of said first latch, a second TDPU and a second switch connected to an output of said comparator being closed when said UV sensor senses glue, said second TDPU providing said second signal if said second switch remains closed longer than said excess glue period to an input of said second NAND gate, and wherein an output of said NAND gate sets a third latch, said third latch being reset when said sensing means senses said rear edge of the carton and generating a glue flag when reset if said third latch was set by said second signal.

8. In a carton glue monitoring system including a conveyor moving a plurality of cartons in a first direction, said cartons having a length in said first direction, an encoder providing pulses at a rate proportional to conveyor line speed, a glue applicator applying a glue strip to the cartons on the conveyor in said first direction wherein the glue has a fluorescent material added thereto, a glue check station including a UV source for illuminating the fluorescent material in the glue, and a UV sensor for sensing said fluorescent material, and a rejection device, the improvement comprising:

said glue station further includes a means for detecting glue skips or excess glue, means for generating a glue flag if said glue skips or excess glue are detected, and means for holding said glue flag until said carton exits said glue station, a glue shift register including Y registers and connected to said UV sensor and said encoder for shifting said glue flag in said Y registers, wherein Y is proportional to said encoder rate and a distance between said rejection marking device and said glue station exit minus said carton length, and wherein said glue shift register outputs said glue flag to said rejection device after said glue flag is shifted in said Y registers, said rejection device including a carton sensor and a rejection shift register having Z registers and being connected to said encoder and said glue shift register, said rejection shift register shifting said glue flag Z times wherein Z is proportional to said carton length, and wherein said rejection device identifies said carton when said glue flag is shifted through said Z registers.

9. The improved carton glue monitoring system of claim 8 further including:

a skew station including means for determining if said carton is skewed, means for providing a skew flag if said carton is skewed, and means for holding said skew flag until said carton exits said skew station; and means for storing said skew flag until said front edge of said carton reaches said rejection device and then transmitting said glue flag to said rejection shift register.

10. The improved carton glue monitoring system of claim 9 wherein said storing means includes a skew shift register including X registers, said skew shift register connected to said UV sensor and said encoder for shifting said glue flag in said X registers, wherein X is proportional to said encoder rate and a distance between said rejection marking device and said skew station exit minus the carton length, and wherein said skew shift register outputs said skew flag to said rejection shift register after said skew flag is shifted in said X registers.

11. The improved carton glue monitoring system of claim 8 wherein said carton includes a first, second and trigger flap and said glue monitoring system further includes:

a flap check, station including flap timing sensor for sensing said trigger flap and for providing a flap timing pulse when said trigger flap is detected;

flap sensing means for detecting said first and second flaps and for providing a flap flag if said first or second flaps are not detected during said flap timing pulse; and means connected to said flap sensing means for storing said flap flag until said front edge of said carton reaches said rejection device and then transmitting said flap flag to said rejection shift register.

12. The improved carton glue monitoring system of claim 11 wherein said storing means includes a flap shift register connected to said flap sensing means and said encoder and having F registers, wherein F is proportional to said encoder rate and a distance between an exit of said flap check station and said rejection device minus said carton length.

13. The improved carton glue monitoring system of claim 8 further including:

a doubles check station having a doubles detecting means for detecting a carton stacked on another carton as the stacked cartons move pass the double check station on the conveyor, for generating a doubles flag if said stacked carton is detected, and for holding said doubles flag until said carton exits said doubles check station, means connected to said doubles detecting means for storing said doubles flag until said front edge of said carton reaches said rejection device and then transmitting said doubles flag to said rejection shift register.

14. The improved carton glue monitoring system of claim 13 wherein said storing means includes a doubles shift register having D registers said doubles shift register being connected to said doubles detecting means, said rejection shift register and said encoder, wherein D is proportional to said encoder rate and a distance between an exit of said double check station and said rejection device minus said carton length, and wherein said doubles shift register outputs said doubles flag to said rejection shift register after said doubles flag is shifted in said D registers.

15. The improved carton glue monitoring system of claim 8 further including:

an insert check station having insert sensing means for detecting said insert on said carton, means for providing a insert flag if said insert is not detected, and means for holding said insert flag until said carton exits said insert check station; and means connected to said insert sensing means for storing said insert flag until said front edge of said carton reaches said rejection device and then transmitting said insert flag to said rejection shift register.

16. The improved carton glue monitoring system of claim 15 wherein said storing means includes an insert shift register including C registers, said insert shift register being connected to said encoder for shifting said insert flag in said C registers, wherein C is proportional to said encoder rate and a distance between said rejection device and an exit of said insert check station minus the carton length, and wherein said insert shift register outputs said insert flag to said rejection device after said insert flag is shifted in said C registers.

17. The improved carton glue monitoring system of claim 8 wherein said cartons include markings thereon:

a wrong copy check station having mark means for sensing said marks, means for providing a wrong copy flag if said markings are not detected, and means for holding said wrong copy flag until said carton exits said wrong copy check station; and means connected to said mark sensing means for storing said wrong copy flag until said front edge of said carton reaches said rejection device and for transmitting said wrong copy flag to said rejection shift register.

18. The improved carton glue monitoring system of claim 17 wherein said storing means includes a wrong copy shift register including W registers, said wrong copy shift register being connected to said encoder for shifting said wrong copy flag in said W registers, wherein W is proportional to said encoder rate and a distance between said rejection device and the exit of said wrong copy check station minus the carton length, and wherein said wrong copy shift register outputs said wrong copy flag to said rejection device after said wrong copy flag is shifted in said W registers.

19. A carton conveyor including:

a conveyor line moving a plurality of cartons in a first direction, said cartons including a plurality of marks thereon;

a wrong copy detection station including a wrong copy sensor for detecting each mark, a counter connected to said wrong copy sensor for providing an actual count of said marks, means for providing a desired mark count, and means for comparing said desired count with the actual count and providing a wrong copy flag if said desired count and said actual count are not equal when said carton exits said wrong copy station;

a rejection device for identifying a carton to be rejected and including a rejection shift register including Z registers, wherein Z is proportional to carton length;

means connected to said comparing means for storing said wrong copy flag until said front edge of said carton reaches the rejection device and then transmitting said wrong copy flag to the rejection shift register, said rejection device identifying the carton to be rejected after said wrong copy flag is shifted through the Z registers.

20. The carton conveyor of claim 19 wherein said storing means includes a wrong copy shift register having W registers, said wrong copy shift register being connected to said encoder and said comparing means for shifting said wrong copy flag in said W registers, wherein W is proportional to said encoder rate and a distance between said exit of said wrong copy station and said rejection device minus said carton length.

21. The carton conveyor of claim 19 wherein said means for providing the desired count includes a plurality of switches.

22. The carton conveyor of claim 21 wherein said comparing means includes a plurality of exclusive OR gates having a first input connected to one of said plurality of switches and a second input connected to said counter.

23. The carton conveyor of claim 22 wherein outputs of each of said plurality of exclusive OR gates are connected to inputs of an OR gate the output of the OR gate providing said wrong copy flag.

24. A monitoring system for detecting defects in a carton including:

a conveyor line moving a plurality of cartons in a first direction, the cartons having front and rear edges and a length in the direction of movement of the conveyor line;

an encoder providing pulses at a rate proportional to conveyor line speed;

means for indicating a defective carton to be rejected;

means for detecting the front and rear edge of a carton on the conveyor;

means connected to said edge detecting means for sensing a defect in said carton after said front edge is detected and before said rear edge is detected;

flag generator connected to said defect sensing means for generating a flag in response to said defect;

flag holder connected to said conveyor speed encoder, said flat generator and said defect sensing means for holding said flag until said rear edge is detected and thereafter for transmitting said flag; and first flag storing means connected to said conveyor speed encoder and said flag holder for storing said flag transmitted from said flag holder until said front edge of said carton reaches said rejection device and thereafter for transmitting said flag to said rejection device, wherein said indicating means identifies said defective carton if the flag is received from said first flag storing means.

25. The monitoring system of claim 24 wherein said indicating means includes a second flag storing means connected to said conveyor speed encoder and said first flag storing means for storing the flag transmitted from said first flag storing means while said conveyor moves said carton a distance equal to the length of the carton and thereafter for triggering said indicating means.

26. The monitoring system of claim 25 wherein the second flag storing means is a shift register connected to said first flag storing means and said encoder, and wherein said shift register includes Z registers wherein Z is proportional to the length of the carton and the encoder rate.

27. The monitoring system of claim 24 wherein the first flag storing means is a shift register connected to said conveyor speed encoder and said flag holder, and wherein said shift register has X registers wherein X is proportional to the encoder rate and a distance between said defect sensing means and said indicating means minus the carton length.

28. The monitoring system of claim 24 wherein the edge detecting means includes a start sensor for sensing said front edge and a stop sensor for sensing a rear edge.

29. The monitoring system of claim 28 wherein said holding means is a latch set by said flag and reset when said stop sensor detects said rear edge.

* * * * *